United States Patent [19]

Barbato

[11] Patent Number: 4,718,554

[45] Date of Patent: Jan. 12, 1988

[54] METHOD OF CARDING PIERCED EARRINGS AND ASSEMBLY THEREBY FORMED

[75] Inventor: Vincent J. Barbato, Cranston, R.I.

[73] Assignee: Pakula and Company, Chicago, Ill.

[21] Appl. No.: 921,634

[22] Filed: Oct. 21, 1986

[51] Int. Cl.[4] ..... B65D 73/00; B65B 15/02

[52] U.S. Cl. ..... 206/477; 53/397; 53/448; 63/12; 206/486; 206/495

[58] Field of Search ..... 53/390, 397, 448, 580; 63/1 R, 2, 12, 20; 206/487–490, 495, 566, 486, 477; 211/60.1, 70.1, 131; 411/377

[56] References Cited

U.S. PATENT DOCUMENTS

| | | | |
|---|---|---|---|
| 2,472,532 | 6/1949 | Hellman | 206/488 |
| 4,099,611 | 7/1978 | Feibelman | 206/490 |
| 4,424,657 | 1/1984 | Lawson, Jr. et al. | 53/580 |
| 4,624,585 | 11/1986 | Nix et al. | 411/377 |
| 4,630,452 | 12/1986 | Connelly | 63/12 |

FOREIGN PATENT DOCUMENTS

| | | | |
|---|---|---|---|
| 0399361 | 10/1933 | United Kingdom | 206/566 |

*Primary Examiner*—Jimmy G. Foster

*Attorney, Agent, or Firm*—Salter & Michaelson

[57] ABSTRACT

A method of assembling a pierced earring on a display card includes the steps of mounting an earring clutch in an aperture in the card so that the clutch is releasably secured in the aperture and then slidably inserting the post of the pierced earring through the mounted clutch. The method can be effectively adapted for automated assembly apparatus, and the assemby formed by the method is effective in that it permits the earring to be removed from the card for inspection while the clutch thereof remains attached to the card.

6 Claims, 7 Drawing Figures

METHOD OF CARDING PIERCED EARRINGS AND ASSEMBLY THEREBY FORMED

BACKGROUND AND SUMMARY OF THE INVENTION

The instant invention relates to display apparatus for jewelry items and more particularly to an improved method of mounting pierced earrings on display cards.

It has long been recognized that display cards can be effectively utilized for packaging and displaying jewelry items, such as pierced earrings. In this connection, in most cases, the display cards which have heretofore been used for displaying pierced earrings have comprised a substantially planar cardboard or plastic card having a pair of spaced, reduced apertures therethrough, and means for hanging or suspending the card from a display rack. For use of a display card of this type a pair of earrings is assembled with the card so that the posts of the earrings extend through the apertures in the card, and thereafter clutches are assembled with the posts on the rear side of the card. It has been found that when earrings are assembled on a display card in this manner, they can be effectively and attractively displayed on various types of display racks in retail establishments. In addition, it has been found that when earrings are assembled on cards in this manner, they can be effectively maintained in matched pairs, and the clutches of the earrings can be maintained in assembled relation with the earrings so that they are not easily lost during shipping and handling. Accordingly, it has generally been found that jewelry dislay cards provide various benefits to those involved in handling and marketing pierced earrings from the time that they are manufactured to the time that they are sold to users.

Although heretofore it has generally been the practice of most earring manufacturers to assemble earrings on display cards by inserting the posts of the earrings through the apertures in the display cards and thereafter assembling clutches on the posts on the back side of the card, it has been found that this procedure does have certain disadvantages. Specifically, it has been found that this procedure can be time consuming and that it is not readily adapted for mechanized or automated assembly operations. It has also been found that when earrings are assembled on display cards in this manner, the clutches thereof can easily be lost when the earrings are removed from the cards thereof by prospective purchasers.

The instant invention provides an improved method of assembling a pair of pierced earrings on a display card which overcomes the disadvantages of the heretofore known methods. Specifically, the instant invention provides a method of assembling a pair of pierced earrings on a display card comprising the steps of assembling a pair of earring clutches on a display card so that the clutches are releasably secured in the apertures in the display card, and assembling a pair of earrings with the clutches so that the posts of the earrings are received in the apertures in the clutches. The clutches perferably comprise bullet-type clutches having annular grooves therein, and they are preferably assembled with the apertures in the display card so that the card engages the clutches in the annular grooves thereof to retain the clutches on the card. The apertures in the display card are preferably of substantially the same diameter as the annular grooves in the clutches so that the clutches can easily be snap-received in the apertures, and hence the apertures are preferably of slightly larger diameter than the apertures in conventional display cards which are dimensioned for receiving the posts of earrings rather than the clutches thereof.

It has been found that the method of the instant invention has certain specific advantages over the heretofore known methods for carding pierced earrings. In particular, it has been found that by assembling the clutches of a pair of earrings in a pair of apertures in a display card, the step of assembling the posts of the earrings with the clutches thereof can easily be carried out by means of automated assembly equipment so that the whole process of assembling the earrings on the card can be completed more quickly and efficiently. Further, by assembling the clutches in apertures in the card, the clutches are secured to the card itself so that they remain with the card when the earrings are removed from the card. As a result, prospective purchasers can remove one or both of the earrings to examine them or try them on without causing the clutches to fall from the back of the card; and hence the clutches are less likely to become lost.

The closest prior art to the subject invention of which the applicant is aware is disclosed in the U.S. Pat. Nos. to RODA, 1,373,097; FENNIMORE, 1,421,196; ORMSBEE, 1,539,405; NEUGEBAUER, 2,847,121; LENTZ, 2,883,048; AX, 3,125,221; FEIBELMAN, 4,099,611; and WAITZMAN, 4,511,041. However, since these patents clearly fail to suggest the concept of securing the clutches of a pair of pierced earrings in apertures in a display card so that the clutches are snap-received in the apertures and hence releasably secured to the card, they are believed to be of only general interest with respect to the subject invention.

Accordingly, it is a primary object of the instant invention to provide an improved method of carding pierced earrings.

Another object of the instant invention is to provide a method of carding pierced earrings which is adapted for automated assembly procedures.

A still further object of the instant invention is to provide a carded pierced earring assembly wherein a pair of bullet-type clutches are releasably secured in apertures in a display card.

An even further object of the instant invention is to provide a carded pierced earring assembly wherein a prospective purchaser can remove an earring from the assembly without causing the clutch of the earring to also be removed therefrom.

Other objects, features and advantages of the invention shall become apparent as the description thereof proceeds when considered in connection with the accompanying illustrative drawings.

DESCRIPTION OF THE DRAWING

In the drawing which illustrates the best mode presently contemplated for carrying out the present invention.

DESCRIPTION OF THE INVENTION

Figure 1:
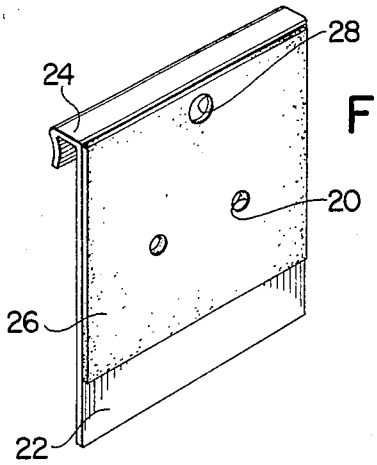
FIG. 1 is a perspective view of a jewelry display card of the type utilized in the method of the subject invention.
Figure 2:
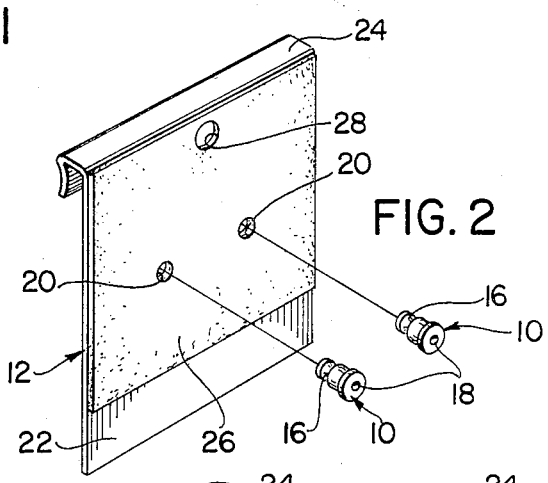
FIG. 2 illustrates the assembly of a pair of clutches on the card.
Figure 3:
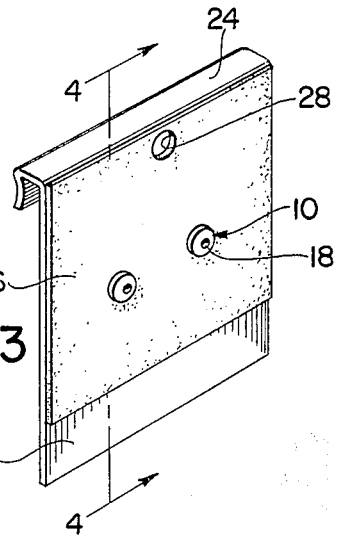
FIG. 3 is a perspective view of the card with the clutches assembled thereon.
Figure 7:
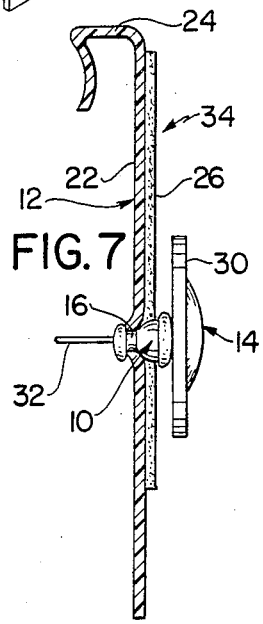
FIG. 7 is a sectional view taken along line 7—7 in FIG. 6.
Figure 6:
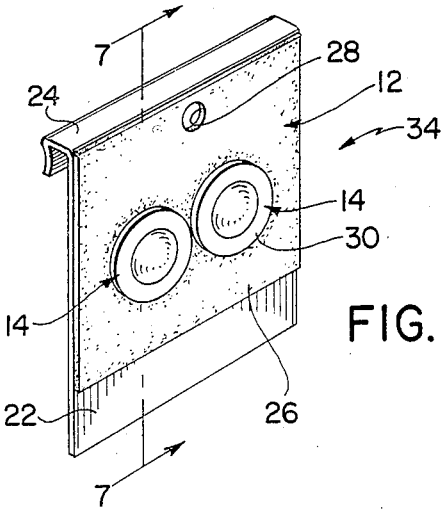
FIG. 6 is a perspective view of the card with the earrings assembled thereon.

Referring now to the drawing, the method of the subject invention is illustrated in FIGS. 1-7, and the assembly formed by the method is illustrated in FIGS. 6 and 7. As illustrated, the method of the subject invention is operative for assembling a pair of clutches 10 on a display card 12 so that the clutches 10 are releasably secured on the card and for assembling a pair of earrings 14 with the clutches 10 so that the earrings 14 are displayed on the front side of the card 12.

The clutches 10 preferably comprise conventional bullet-type clutches, and they preferably have annular grooves 16 thereon and axial apertures 18 which are adapted for receiving and grasping the posts of conventional pierced earrings.

The display card 12 is of generally conventional construction, although it has a pair of spaced apertures 20 therethrough which are preferably of substantially the same diameter as the annular grooves 16 and which are therefore somewhat larger than the apertures in a conventional display card. The display card 12 comprises a main card portion 22 and a top hanger portion 24 which are preferably integrally made from a suitable resiliently deformable plastic material, and a decorative fabric layer 26 which overlies and is secured to the front surface of the card portion 22. The apertures 20 extend through both the card portion 22 and the fabric layer 26, and they are disposed in spaced relation in the central portion of the card 12. Extending through the fabric layer 26 and the card portion 22 adjacent the upper edge of the card 12 is an aperture 28, and an opening (not shown) which is aligned with the aperture 28 is provided in the hanger portion 24. Accordingly, the display card 12 is alternatively securable on a display rack by suspending it therefrom with the hanger portion 24 or by passing a rod or hook through the aperture 28.

The earrings 14 are preferably of conventional construction and they each comprise a decorative portion 30 and a rearwardly extending post 32 which is dimensioned to be received and secured in an aperture 18 of a clutch 10.

Figure 4:
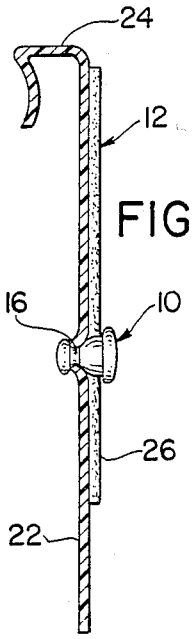
FIG. 4 is a sectional view taken along line 4—4 in FIG. 3.
Figure 5:
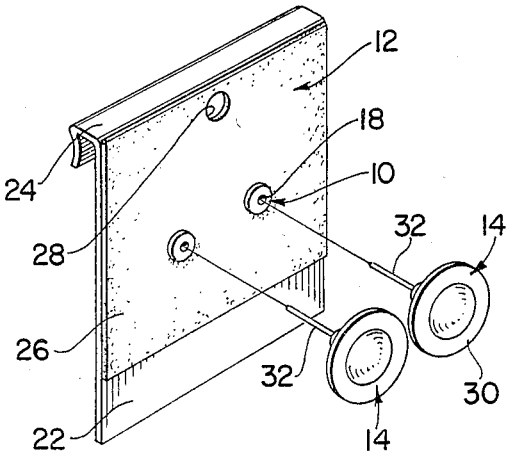
FIG. 5 is a perspective view illustrating the assembly of a pair of earrings with the clutches on the card.

Accordingly, the method of the subject invention is preferably carried out by assembling the clutches 10 in the apertures 20 in the display card 12 so that the card portion 22 engages the clutches 10 in the annular grooves 16 thereof as illustrated most clearly in FIGS. 4 and 7. In this regard, because the card 12 is preferably at least slightly resiliently deformable, it is possible to snap the clutches 10 into the apertures 20 so that the main card portion 22 firmly engages the clutches 10 in the annular grooves 16 thereof to effectively retain the clutches 10 on the card 12, although the clutches 10 are nevertheless removable from the card 12 when desired.

In the second step of the preferred form of the method of the subject invention, the earrings 14 are assembled with the clutches 10 so that the posts 32 of the earrings 14 are received and secured in the apertures 18 in the clutches 10 and so that the decorative elements 30 of the earrings 14 are positioned adjacent to and in front of the clutches 10. In this connection, because the clutches 10 are preferably secured on the card 12 before the earrings 14 are assembled with the clutches 10, the clutches 10 are effectively held in position on the ends 12 to enable the earrings 14 to be easily assembled with them in an automated assembly process. However, it will be understood that although the two clutches 10 are preferably assembled on the card 12 before the earrings 14 are assembled with the clutches 10, other forms of the method wherein a single clutch 10 and a single earring 14 are assembled on the card 12 or wherein the clutches 10 are assembled with the earrings 14 before they are asembled on the card 12 are contemplated.

The assembly comprising the card 12 with the clutches 10 assembled thereon and with the earrings 14 assembled with the clutches 10 is illustrated in FIGS. 6 and 7 and generally indicated at 34. As will be seen most clearly from FIG. 7, once the clutches 10 have been assembled on the card 12, they are effectively releasably secured in the apertures 20 so that the posts 32 of the earrings 14 can be assembled with or removed from the clutches 10 without removing the clutches 10 from the card 12. As a result, it is possible to assemble the earrings 14 with the clutches 10 in an automated assembly process, and it is also possible for a prospective purchaser to remove one or both of the earrings 14 from the assembly 34 without removing the clutches 10 from the card 12 so that the clutches 10 are not easily lost. Further, once a purchaser has examined the earrings 14 and/or tried them on, the earrings 14 can be easily reassembled with the clutches 10 on the card 12 to again form the assembly 34.

It is seen therefore that the instant invention provides a highly effective method of assembling a pair of earrings and earring clutches on a display card. Specifically, by assembling the clutches 10 on the display card 12 so that the clutches 10 are received and releasably secured in the apertures 20, the posts 32 of the earrings 14 can be easily assembled with the clutches 10 in an automated assembly process. Further, by assembling the clutches 10 so that they are releasably secured on the card 12, the earrings 14 can be removed from the card 12 without removing the clutches 10 from the card 12. As a result, the earrings 14 can be examined or tried on by prospective purchasers without risking loosing the clutches 10. Hence, it is seen that both the method of the instant invention and the assembly formed by the method represent significant advancements in the art which have substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. A method of carding a pierced earring comprising the steps of:

(a) assembling an earring clutch with an earring display card, said display card being of a type which is adapted to be suspended from a display hanger and including a main card portion, said main card portion having an aperture therethrough, said clutch being assembled with said display card so that it is releasably secured in said aperture; and (b) assembling a pierced earring with said clutch by slidably inserting the post of said earring through said clutch.

2. In the method of claim 1, said clutch further characterized as a bullet-type clutch having an external annular groove thereon, said clutch assembling step further characterized as assembling said clutch with said display card so that it is snap-received in said aperture and so that said display card engages said clutch in said annular groove to releasably secure said clutch on said display card.

3. In the method of claim 2, said aperture in said display card being of substantially the same diameter as said annular groove.

4. A method of carding a pair of pierced earrings comprising the steps of:

(a) assembling a pair of bullet-type earring clutches with an earring display card, said display card being of a type which is adapted to be suspended from a display hanger and including a main card portion having a pair of spaced apertures therethrough, said clutches having external annular grooves thereon, said apertures being of substantially the same diameter as said grooves, said clutches being inserted in said apertures from the front side of said display card and being assembled with said display card so that said display card engages said clutches in said annular grooves thereon; and (b) thereafter assembling said earrings with said clutches on said display card so that the posts of said earrings are received in their respective clutches.

5. The assembly formed by the method of claim 1.

6. The assembly formed by the method of claim 4.

* * * * *